US011787602B2

(12) United States Patent
Tuan

(10) Patent No.: US 11,787,602 B2
(45) Date of Patent: Oct. 17, 2023

(54) COVER STRUCTURE

(71) Applicant: Ronald Tuan, Nantou County (TW)

(72) Inventor: Ronald Tuan, Nantou County (TW)

( * ) Notice: Subject to any disclaimer, the term of this patent is extended or adjusted under 35 U.S.C. 154(b) by 0 days.

(21) Appl. No.: 17/689,877

(22) Filed: Mar. 8, 2022

(65) Prior Publication Data

US 2022/0185547 A1 Jun. 16, 2022

Related U.S. Application Data

(63) Continuation-in-part of application No. 16/953,355, filed on Nov. 20, 2020, now abandoned.

(30) Foreign Application Priority Data

Feb. 13, 2020 (TW) ..... 109104457

(51) Int. Cl.
*B65D 43/02* (2006.01)
*B65D 25/10* (2006.01)

(52) U.S. Cl.
CPC ..... *B65D 43/0208* (2013.01); *B65D 25/108* (2013.01); *B65D 2543/005* (2013.01); *B65D 2543/0062* (2013.01); *B65D 2543/0074* (2013.01); *B65D 2543/0099* (2013.01); *B65D 2543/00203* (2013.01); *B65D 2543/00537* (2013.01); *B65D 2543/00555* (2013.01)

(58) Field of Classification Search
CPC ..... B65D 43/0218; B65D 2543/00101; B65D 2543/00296; B65D 2543/00203
See application file for complete search history.

(56) References Cited

U.S. PATENT DOCUMENTS 4,376,493 A 3/1983 Gall
9,782,029 B1 10/2017 FitzSimons

*Primary Examiner* — Jeffrey R Allen

(57) ABSTRACT

A cover structure is disclosed. When an annular sealing portion of a cover body is engaged with a container, a sealing section of the annular sealing portion abuts against an annular inner surface of the container, and then, a folding section of the annular sealing portion is folded to a sealing state, so that part of the folding section abuts against the annular outer surface of the container to form a dual leak-proof sealing structure. The folding section of the annular sealing portion is an annular elastic and full-peripheral tightening structure. Therefore, the sealing between the container and the cover may be strengthened for a good sealing effect, and preventing liquid in the container from being splashed on surrounding articles. When the folding section is in the unsealing state, the cover can be separated from the container, which is convenient to carry and use.

7 Claims, 6 Drawing Sheets

COVER STRUCTURE

CROSS REFERENCE TO RELATED APPLICATION

This application is a continuation in part of U.S. patent application Ser. No. 16/953,355, which claims the earlier filing date of Nov. 20, 2020, the partial contents of the specification is incorporated herein by reference.

BACKGROUND

Field of the Invention

The present invention relates to a cover structure, and more particularly to a cover structure capable of airtightly engaged with a container.

Description of Related Art

Please refer to U.S. Pat. No. 9,782,029B1, which relates to a lid and a method of using a lid. The lid includes a body having a top surface, a bottom surface, and a perimeter. The lid also includes a sealing member carried by the perimeter of the body. The sealing member is configured to move between a first position and a second position to cover an open end of a container. U.S. Pat. No. 4,376,493 also relates to a lockable closure for a container, wherein a lid having an annular lip is disclosed, the lid includes a shoulder portion adapted to be disposed in contact with a portion of the annular lip of the lid, so that the lid won't be easily disengaged from the container.

However, the lids disclosed above are made of soft materials, and the lids completely made of soft materials are easily deformed arbitrarily, especially when the container with the lid is moved, the soft lid is easily deformed due to the collision during the movement, so that the lid and the container cannot be completely sealed and the internal liquid leaks.

Therefore, how to solve the above-mentioned problems and deficiencies is the direction that the inventor of the present invention and related businesses engaged in this direction are eager to research and improve.

SUMMARY

One objective of the present invention is to provide a cover structure, which can be tightly engaged with the container to form a multiple-tight-fitting form.

To achieve the above objective, a cover structure suitable for use with a container is provided by the invention, the container includes an annular inner surface and an annular outer surface opposite the annular inner surface, and the cover structure comprises:

a cover body configured for covering the container, wherein an annular sealing portion that is capable of airtightly engaging with a top edge of the container arranged along a peripheral edge of the cover body, a hard annular portion disposed to the annular sealing portion, the annular sealing portion is elastically arranged around a periphery of an opening of the container, and includes a sealing section made of soft materials and capable of abutting against the annular inner surface, and a folding section connected to the sealing section, the folding section is capable of being switched between a sealing state and an unsealing state, the hard annular portion includes a hard abutting surface abutting against the sealing section, when the cover body covers the container, the sealing section is clamped between the hard annular portion and the annular inner surface, when the folding section is folded to the sealing state, part of the folding section is abutted against the annular outer surface, and when the folding section is folded to the unsealing state, the folding section stops abutting against the annular outer surface.

Preferably, the annular outer surface includes a concave area, and when the folding section is folded to the sealing state, the folding section forms a sealing area to press against the concave area and to airtightly match with the concave area in a convex-and-concave manner.

Preferably, the annular sealing portion of the cover body is made of silicone material.

Preferably, the sealing section includes a soft abutting surface abutting against the hard abutting surface, the hard annular portion includes a positioning convex portion annularly protruding from the hard abutting surface, the cover body includes a positioning concave portion recessed from the soft abutting surface, and the positioning concave portion and the positioning convex portion match with each other in a concave-and-convex manner.

Preferably, the sealing section of the annular sealing portion includes an outer abutting surface for abutting against the annular inner surface, the sealing section includes an annular convex portion protruding from the outer abutting surface, the annular inner surface includes an annular concave portion, and when the cover body is assembled with the container, the annular convex portion and the annular concave portion match with each other in a concave-convex manner.

Preferably, when the cover body is combined with the container, the cover body has a bending point abutting against the concave area, when the folding section is folded, the cover body will be folded from the bending point, a distance from the bending point to the annular convex portion is an accommodating-groove width, a distance from the concave area to the annular concave portion of the container is a connecting-head width, and the connecting-head width is larger than the accommodating-groove width.

Preferably, one end of the folding section away from the sealing area includes an inclined surface inclined toward the container, the folding section includes an inner surface abutted against the container, and an outer surface opposite to the inner surface, the outer surface is connected to the inclined surface, the inclined surface is connected to the inner surface, and a length of the outer surface is longer than that of the inner surface.

Preferably, the container includes a first bowl portion and a second bowl portion connected to each other, the first bowl portion has a bowl shape and is used to be placed on the table top, and the second bowl portion is connected to the first bowl portion to define the opening of the container, the first bowl portion is made of a soft material, the second bowl portion is made of a hard material, and when the cover body covers the container, the sealing section is located between the second bowl portion and the hard annular portion.

Since the second bowl portion is made of hard material, when the cover body covers the container, the soft folding section can covers the second bowl portion. Since the second bowl portion is made of hard material, the second bowl portion will not be deformed arbitrarily when covered by the folding section, and the folding section can tightly wrap around the second bowl portion, thereby making the cover body more difficult to detach from the container.

Furthermore, the cover body is made of silicone material so that the cover body has good elasticity, stretchability and heat resistance, and can be cleaned and used repeatedly, which is environmentally friendly and does not cause any waste.

After studying the detailed description in conjunction with the following drawings, other aspects and advantages of the present invention will be discovered.

DETAILED DESCRIPTION

Figure 1:
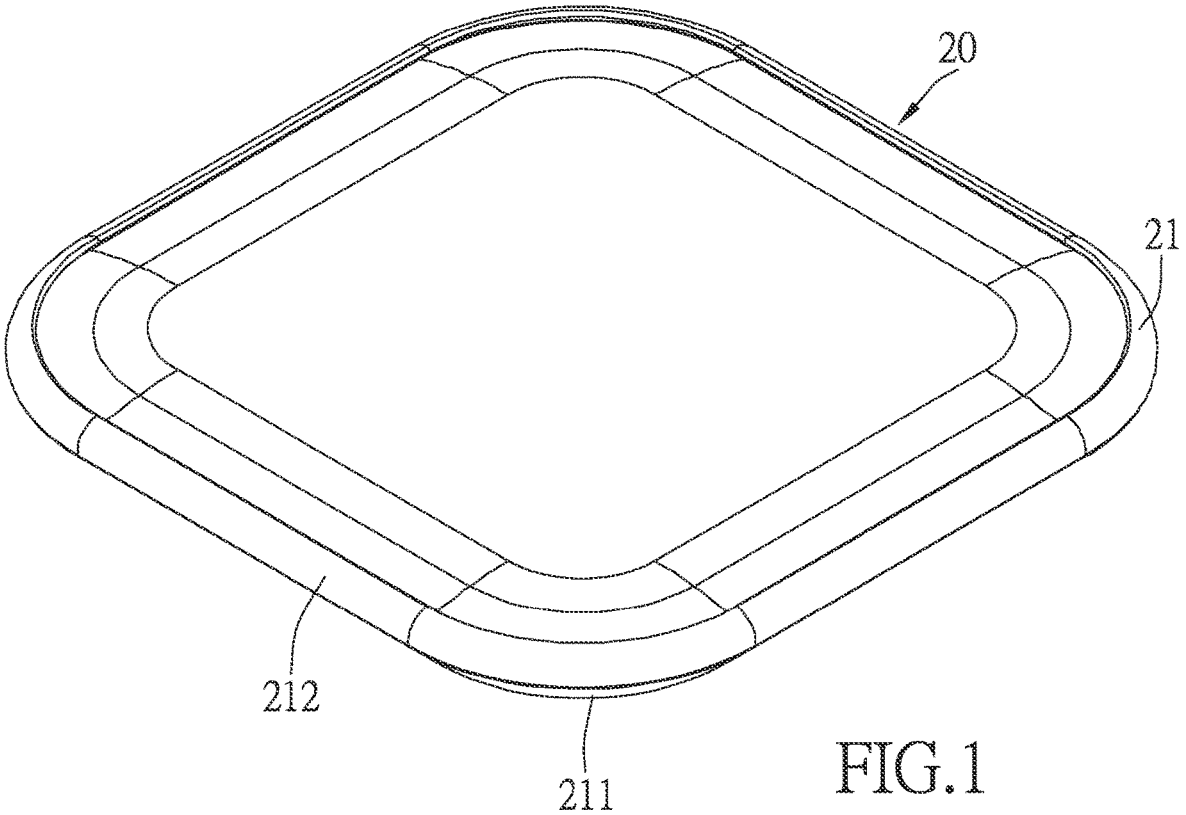
FIG. 1 is a perspective view of the present invention.
Figure 2:
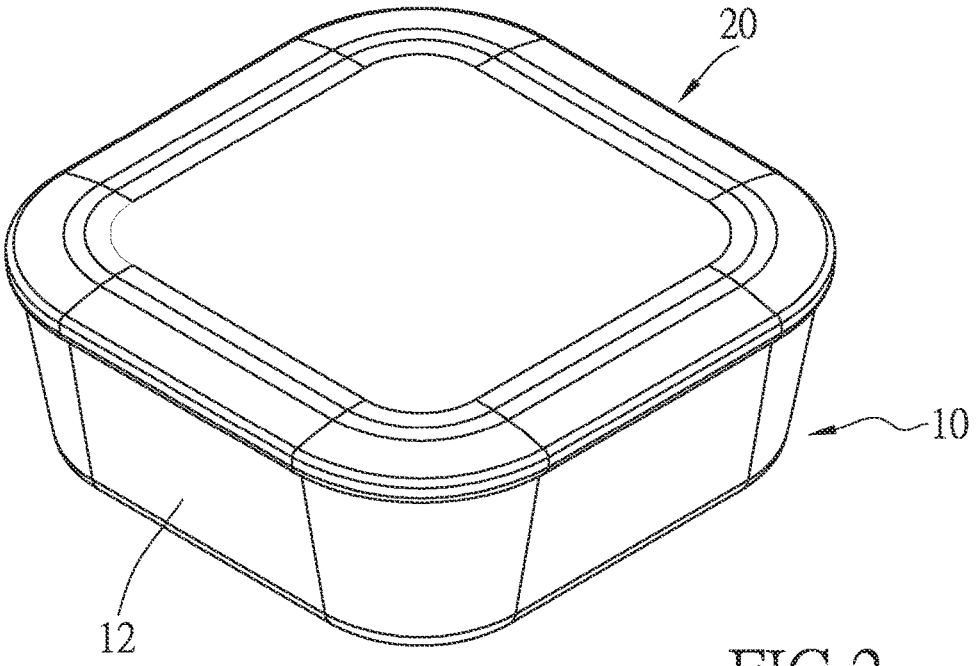
FIG. 2 is a perspective view of the combination of the cover body and the container in a preferred embodiment of the present invention.
Figure 3:
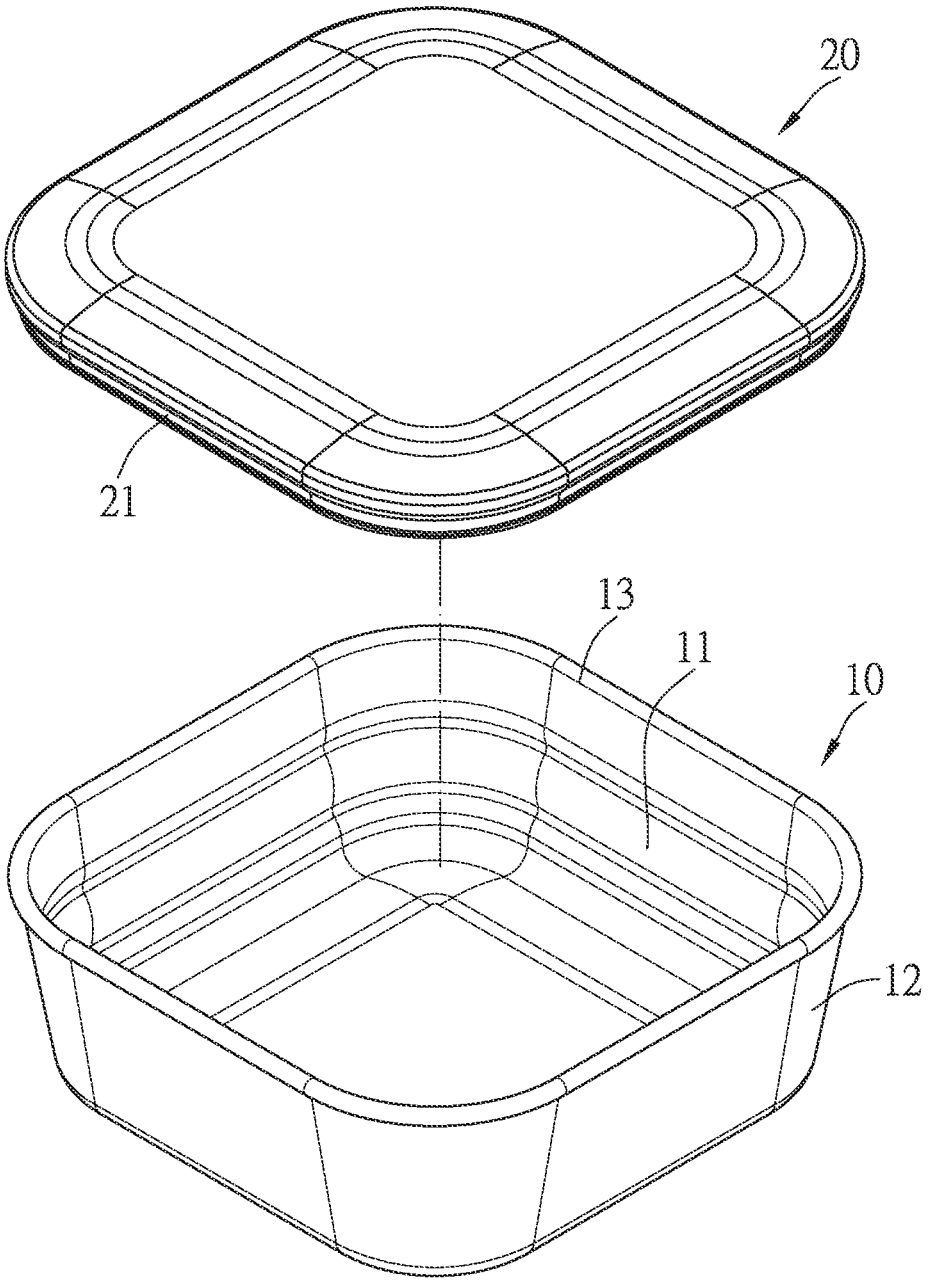
FIG. 3 is an exploded perspective view of the cover body and the container of the present invention.
Figure 4:
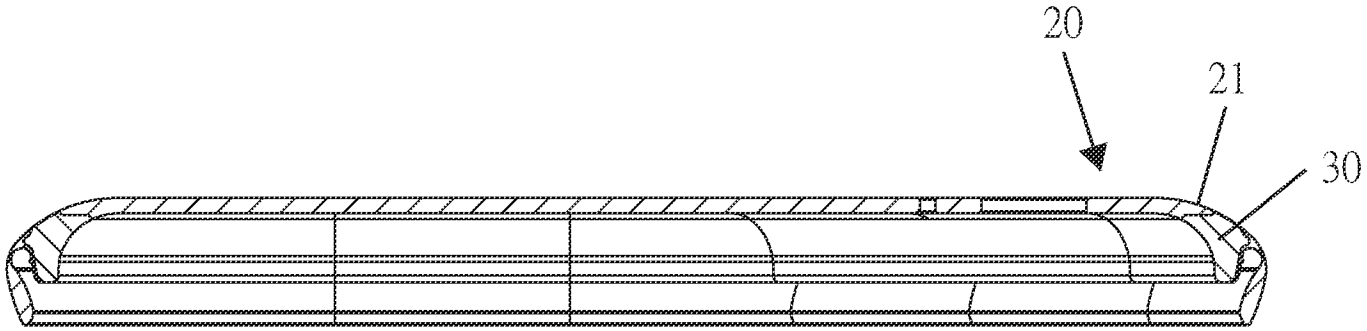
FIG. 4 is a cross-sectional view of the cover body in a preferred embodiment of the present invention.

The foregoing and other technical content, features, and effects of the present invention will be clearly presented in the following detailed description of the preferred embodiment with reference to the drawings.

Referring to FIGS. 1-5, an embodiment of the present invention provides a cover structure suitable for use with a container 10, the container 10 is square, and includes an annular inner surface 11, an annular outer surface 12 opposite the annular inner surface 11, and an opening 13 located at the top of the container 10. The cover structure comprises a cover body 20.

The cover body 20 covers the top of the container 10. An annular sealing portion 21 that is capable of airtightly engaging with a top edge of the container 10 is arranged along a peripheral edge of the cover body 20, and a hard annular portion 30 disposed to the annular sealing portion 21. The annular sealing portion 21 is elastically arranged around a periphery of the opening 13 of the container 10, and includes a sealing section 211 made of soft materials and capable of abutting against the annular inner surface 11, and a folding section 212 connected to the sealing section 211. The folding section 212 can be switched between a sealing state P1 and an unsealing state P2. The hard annular portion 30 includes a hard abutting surface 31 abutting against the sealing section 211. When the cover body 20 covers the container 10, the sealing section 211 is clamped between the hard annular portion 30 and the annular inner surface 11. When folded to the sealing state P1, the folding section 212 is stretched to reach the sealing state P1, and the folding section 212 forms an elastic tightening state by the design of elastic annular shape thereof, so that part of the folding section 212 can be elastically abutted against the annular outer surface 12, and the folding section 212 and the sealing section 211 are separated by a distance D. When the folding section 212 is folded to the unsealing state P2, due to the elastic annular design of the folding section 212, the folding section 212 can be elastically stretched to climb over the edge of the cover body 20 and then be released for contracting, so that the folding section 212 can be maintained at the top of the cover body 20 without going over the cover body 20 to return to the sealing state P1, and the folding section 212 is indeed detached from the annular outer surface 12 to facilitate the lifting of the cover body 20 to put objects in or take objects out of the container at the opening 13 of the container 10.

The annular outer surface 12 of the container 10 includes a concave area 111. When the folding section 212 is folded to the sealing state P1, the folding section 212 forms a sealing area 2121 to press against the concave area 111 and to tightly match with the concave area 111 in a convex-and-concave manner, thereby forming an airtight state to prevent air from entering the container 10 from the gap to ensure that the atmospheric pressure outside the container 10 is greater than the gas pressure in the container 10 to isolate the space in the container 10 from the outside.

The hard annular portion 30 can be made of high-density polyethylene (PE, High-density polyethylene), polypropylene (PP, Polypropylene), melamine, ABS resin (ABS), polymethyl methacrylate (PMMA), Polycarbonate (PC), Nylon and Glass Fiber Reinforced Plastic, etc., but not limited thereto, the hard annular portion 30 can still be made of other hard and heat-resistant materials.

Figure 5:
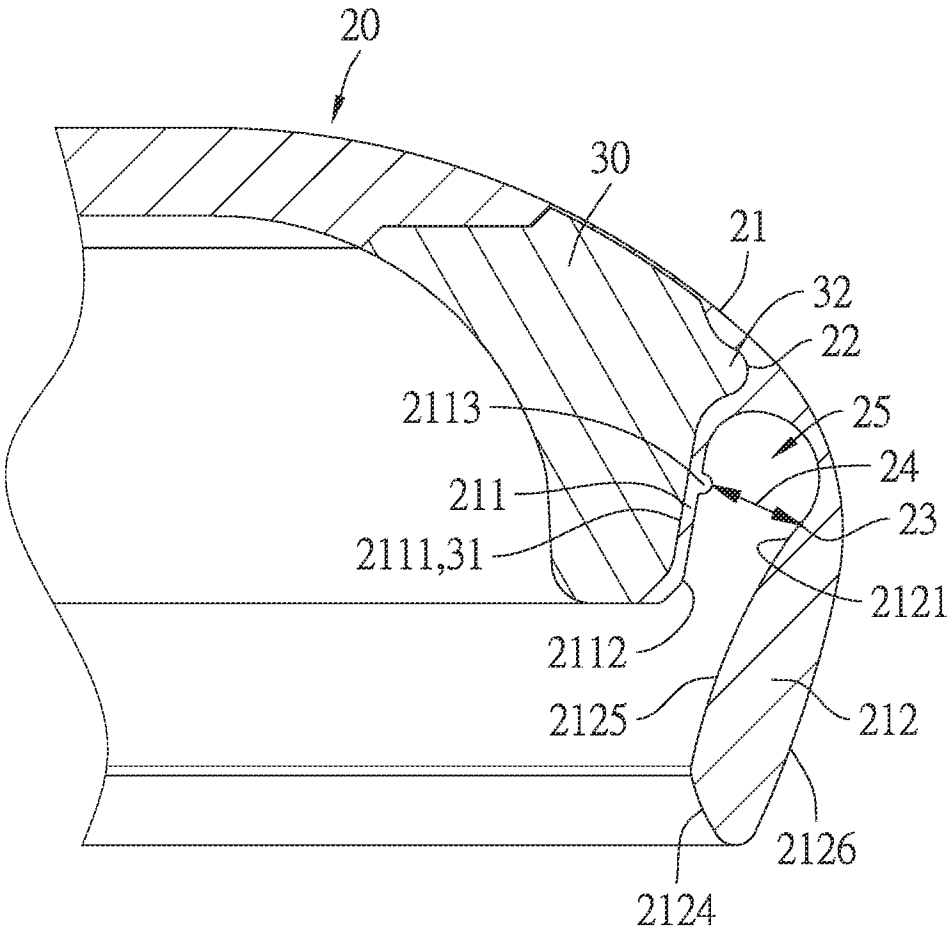
FIG. 5 is a magnified cross-sectional view of a part of the cover body in a preferred embodiment of the present invention.
Figure 6:
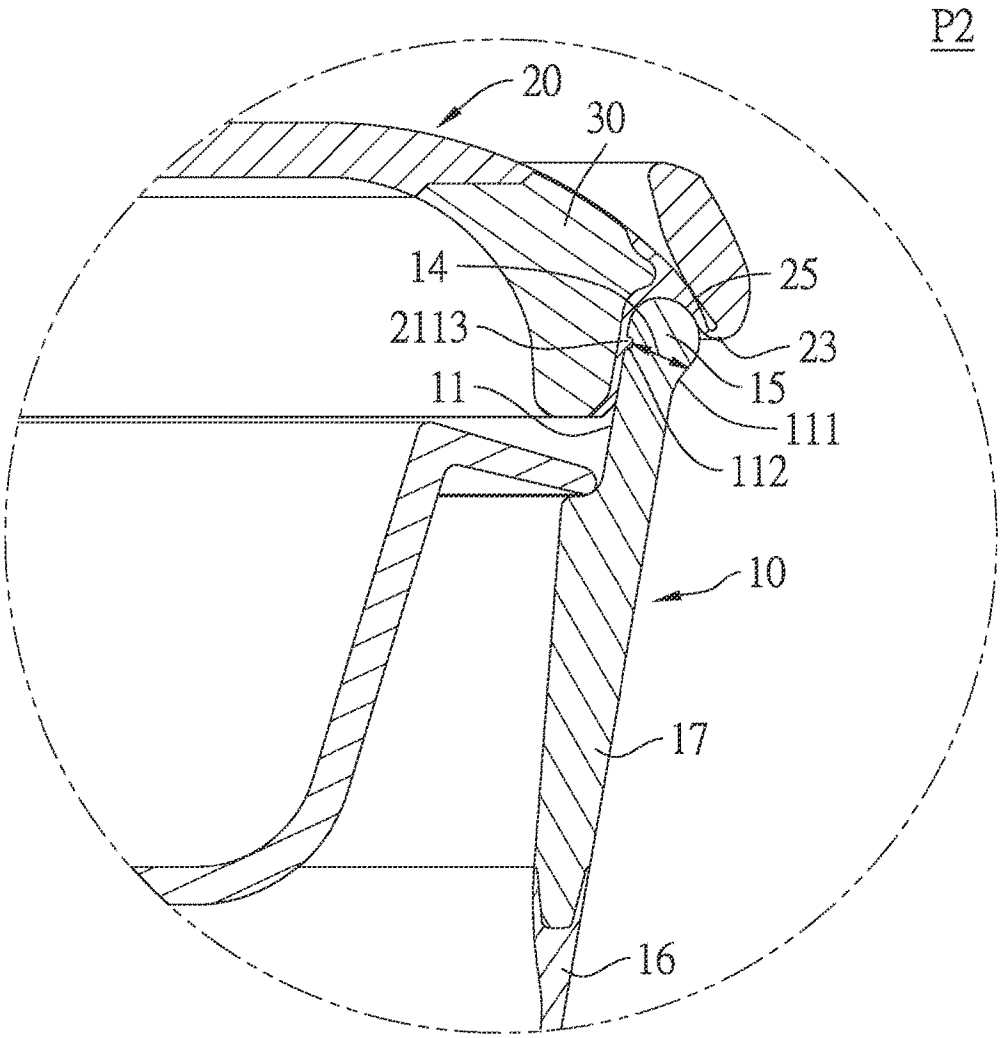
FIG. 6 is a cross-sectional view showing that the annular sealing portion in a preferred embodiment of the present invention is folded.

Please refer to FIGS. 5 and 6, the cover 20 includes an accommodating groove 25, and the container 10 includes a connecting head 15, whereby when the cover 20 covers the container 10, the connecting head 15 can be accommodated into the accommodating groove 25, thereby making the assembling of the container 10 and the cover body 20 more secure and stable.

Secondly, the sealing section 211 includes a soft abutting surface 2111 abutting against the hard abutting surface 31. The hard annular portion 30 includes a positioning convex portion 32 annularly protruding from the hard abutting surface 31, the cover body 20 includes a positioning concave portion 22 recessed from the soft abutting surface 2111, and the positioning concave portion 22 and the positioning convex portion 32 match with each other in a concave-and-convex manner, thereby preventing the hard annular portion 30 from detaching from the cover body 20, and the hard annular portion 30 is more firmly combined with the annular sealing portion 21.

Furthermore, the sealing section 211 of the annular sealing portion 21 includes an outer abutting surface 2112 for abutting against the annular inner surface 11, the sealing section 211 includes an annular convex portion 2113 protruding from the outer abutting surface 2112, and the annular inner surface 11 includes an annular concave portion 112. When the cover body 20 is assembled with the container 10, the annular convex portion 2113 and the annular concave portion 112 match with each other in a concave-convex manner, so that the connecting head 15 is less likely to be detached from the accommodating groove 25 to achieve a better sealing effect.

Please refer to FIG. 5 and FIG. 6, when the cover body 20 is combined with the container 10, the cover body 20 has a bending point 23 abutting against the concave area 111, and when the folding section 212 is folded, the cover body 20 will be folded from the bending point 23. A distance from the bending point 23 to the annular convex portion 2113 is an accommodating-groove width 24, a distance from the concave area 111 to the annular concave portion 112 of the container 10 is a connecting-head width 14, and the connecting-head width 14 is larger than the accommodating-groove width 24; When the connecting head 15 is assembled into the accommodating groove 25, the connecting-head width 14 is larger than the accommodating-groove width 24, not only the connecting head 15 can stretch the accommodating groove 25, but also the connecting head 15 is caused to push against the sealing section 211 by stretching the accommodating groove 25, so that the sealing section 211 is pressed against the hard annular portion 30 to achieve a better sealing effect.

Figure 7:
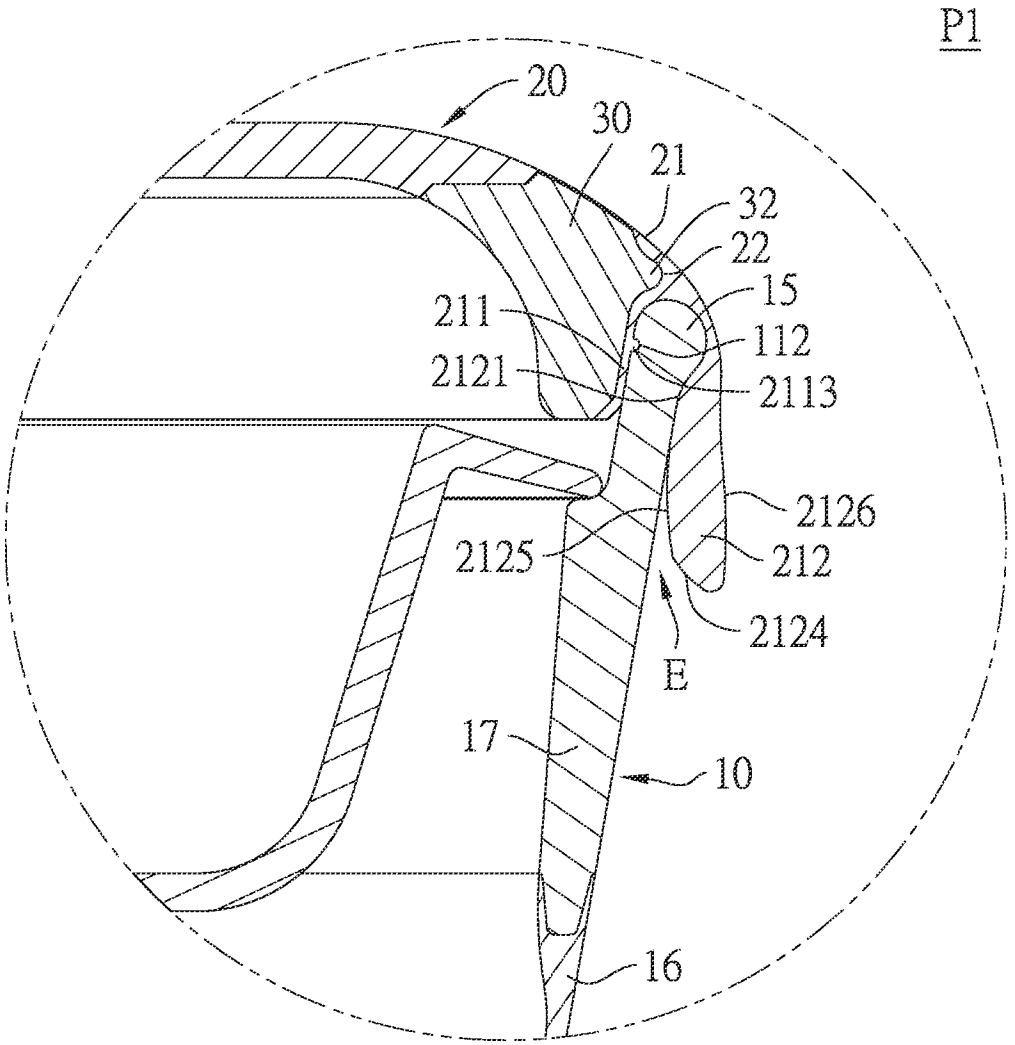
FIG. 7 is a cross-sectional view of the present invention in a use state in a preferred embodiment.

Please refer to FIG. 5 and FIG. 7, one end of the folding section 212 away from the sealing area 2121 includes an inclined surface 2124 inclined toward the container 10, and the folding section 212 includes an inner surface 2125 abutted against the container 10, and an outer surface 2126 opposite to the inner surface 2125. The outer surface 2126 is connected to the inclined surface 2124, the inclined surface 2124 is connected to the inner surface 2125, and the length of the outer surface 2126 is longer than the inner surface 2125, so the inclined surface 2124 is inclined toward the container 10, so as to define a folding space E between the inclined surface 2124 and the container 10. When the user folds the folding section 212, her/his fingers can be inserted into the folding space E, thereby making it easier for the user to fold the folding section 212.

Please refer to FIG. 7, the container 10 includes a first bowl portion 16 and a second bowl portion 17 connected to each other. When the cover body 20 covers the container 10, the sealing section 211 is located between the second bowl portion 17 and the hard annular portion 30. The first bowl portion 16 is made of a soft material, and the soft material is silicone in this embodiment, but is not limited to this material, and of course, it can be replaced with similar materials that are elastic, stretchable, and heat-resistant. The second bowl portion 17 is made of hard material, and the hard material is high-density polyethylene in this embodiment, but is not limited to this material, of course, the material with hardness and heat resistance, such as polypropylene, melamine, ABS resin, polymethyl methacrylate, polycarbonate, nylon, glass fiber reinforced plastics, etc, can also be used. The first bowl portion 16 has a bowl shape and is used to be placed on the table top, and the second bowl portion 17 is connected to the first bowl portion 16 to define the opening of the container 10.

Please refer to FIGS. 6 and 7, it is worth noting that since the second bowl portion 17 is made of hard material, when the cover body 20 covers the container 10, the soft folding section 212 can covers the second bowl portion 17. Since the second bowl portion 17 is made of hard material, the second bowl portion 17 will not be deformed arbitrarily when covered by the folding section 212, and the folding section 212 can tightly wrap around the second bowl portion 17, thereby making the cover body 20 more difficult to detach from the container 10.

It is worth mentioning that the cover body 20 is made of silicone material, but the present invention is not limited to this material. The cover body 20 has good elasticity, stretchability and heat resistance, and can be cleaned and used repeatedly, which is environmentally friendly and does not cause any waste.

While we have shown and described various embodiments in accordance with the present invention, it is clear to those skilled in the art that further embodiments may be made without departing from the scope of the present invention.

What is claimed is:

1. A cover structure suitable for use with a container including an annular inner surface and an annular outer surface opposite the annular inner surface, and the cover structure comprising:

a cover body configured for covering the container, wherein an annular sealing portion that is capable of airtightly engaging with a top edge of the container is arranged along a peripheral edge of the cover body, a hard annular portion connected to the annular sealing portion, the annular sealing portion is elastically arranged around a periphery of an opening of the container, and includes a sealing section made soft materials and capable of abutting against the annular inner surface, and a folding section connected to the sealing section, the folding section is capable of being switched between a sealing state and an unsealing state, the hard annular portion includes a hard abutting surface abutting against the sealing section, when the cover body covers the container, the sealing section is clamped between the hard annular portion and the annular inner surface, when the folding section is abutted against the annular outer surface, part of the folding section is abutted against the annular outer surface, and when the folding section is folded to the unsealing state, the folding section stops abutting against the annular outer surface.

2. The cover structure as claimed in claim 1, wherein the annular outer surface includes a concave area, and when the folding section is folded to the sealing state to press against the concave area and to airtightly match with the concave area in a convex-and-concave manner.

3. The cover structure as claimed in claim 1, wherein the cover body is made of silicone material.

4. The cover structure as claimed in claim 1, wherein the sealing section includes a soft abutting surface abutting against the hard abutting surface, the hard annular portion includes a positioning convex portion annularly protruding from the hard butting surface, the cover body includes a positioning concave portion recessed from the sort abutting surface, and the positioning concave portion and the positioning convex portion match with each in a concave-and-convex manner.

5. The cover structure as claimed in claim 2, wherein the sealing section of the annular sealing portion includes and outer abutting surface for abutting against the annular inner surface, the sealing section includes an annular convex portion protruding from the outer abutting surface, the annular inner surface includes an annular concave portion, and when the cover body is assembled with the container, the annular convex portion and the annular concave portion match with each other in a concave-convex manner.

6. The cover structure as claimed in claim 5, wherein when the cover body is combined with the container, the cover body has a bending point abutting against the concave area, when the folding section is folded, the cover body will be folded from the bending point, a distance from the bending point to the annular convex portion is an accommodating-groove width, a distance from the concave area to the annular concave portion of the container is a connecting-head width, and the connecting-head width is larger than the accommodating-groove width.

7. The cover structure as claimed in claim 2 wherein one end of the folding section away from the sealing area includes an inclined surface inclined toward the container, the folding section inclines an inner surface abutted against the container, and an outer surface opposite to the inner surface, die outer surface is connected to the inclined surface, and a length of the outer surface is longer than that of the inner surface.

* * * * *